United States Patent [19]

Ormond et al.

[11] 4,147,230

[45] Apr. 3, 1979

[54] COMBINATION SPARK ARRESTOR AND ASPIRATING MUFFLER

[75] Inventors: Theodore W. Ormond; Kenneth J. Kicinski, both of Stoughton, Wis.

[73] Assignee: Nelson Industries, Inc., Stoughton, Wis.

[21] Appl. No.: 896,183

[22] Filed: Apr. 14, 1978

[51] Int. Cl.[2] ..... F01N 3/02; F01N 3/06

[52] U.S. Cl. ..... 181/231; 181/262; 181/272; 181/274

[58] Field of Search ..... 181/231, 259, 262, 264, 181/268, 269, 272, 274, 275, 260, 261; 55/257 QV, 257 C, 257 PV, 257 PP, 280, 348, 276, DIG. 20, DIG. 30

[56] References Cited

U.S. PATENT DOCUMENTS

| | | | |
|---|---|---|---|
| 2,548,563 | 4/1951 | Smith | 181/262 |
| 2,832,430 | 4/1958 | Coombs | 181/262 |
| 3,471,265 | 10/1969 | Ciapetta et al. | 181/259 |
| 3,545,179 | 12/1970 | Nelson et al. | 55/276 |

*Primary Examiner*—Richard A. Wintercorn
*Assistant Examiner*—Benjamin R. Fuller
*Attorney, Agent, or Firm*—Andrus, Sceales, Starke & Sawall

[57] ABSTRACT

A spark arrestor aspirating muffler for an internal combustion engine which comprises an outer body or housing having an exhaust gas inlet in one end and a gas outlet in the opposite end. Located immediately upstream of the outlet is a venturi and air is drawn into the throat of the venturi through an air inlet tube connected to a pre-cleaner for the engine. A baffle plate containing a series of louvered openings is positoned upstream of the venturi and the exhaust gases entering the gas inlet conduit are swirled outwardly as they pass through the louvered openings and are discharged through the venturi. The solid particles in the swirling exhaust gas are thrown outwardly and move along the inner surface of a tubular member which is secured to the downstream side of the baffle and are collected in a collection chamber.

11 Claims, 5 Drawing Figures

Fig. 1
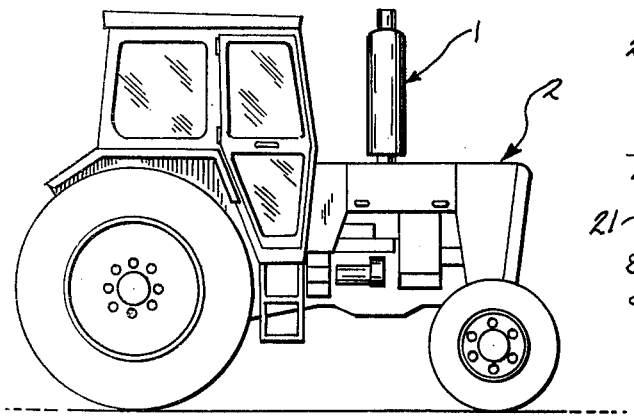
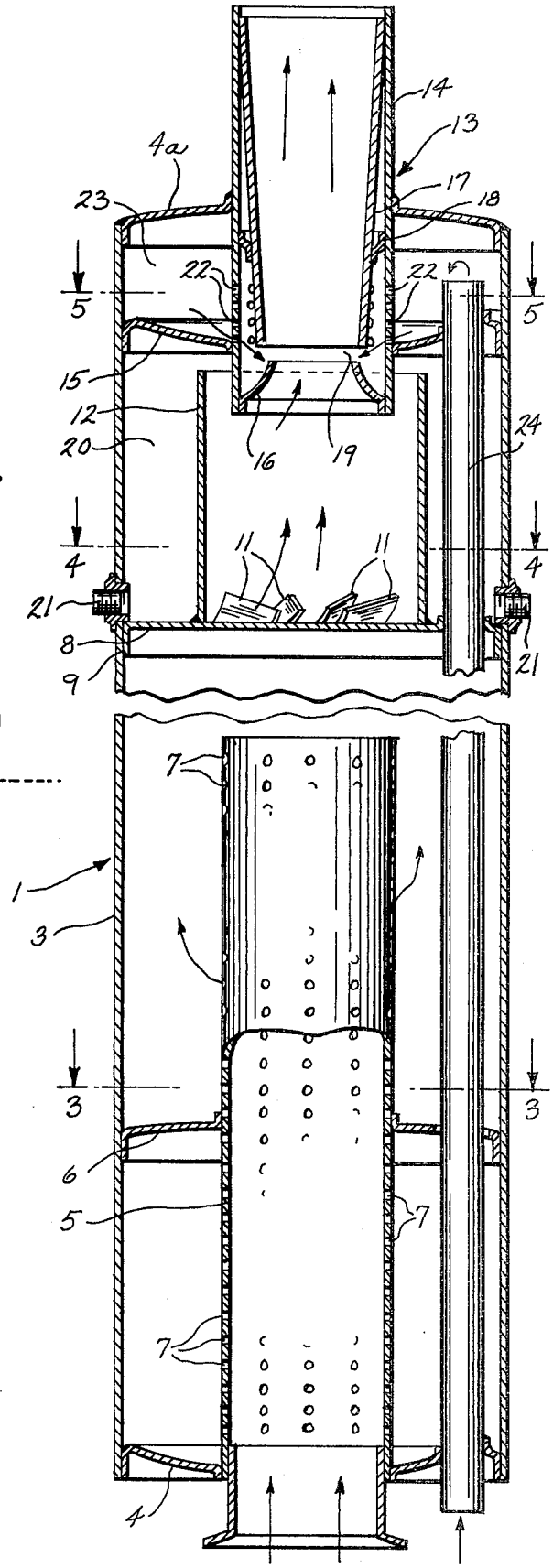
Fig. 2

COMBINATION SPARK ARRESTOR AND ASPIRATING MUFFLER

BACKGROUND OF THE INVENTION

The conventional aspirating muffler, as used in conjunction with an internal combustion engine, includes a venturi through which exhaust gases are discharged, and the throat of the venturi communicates with an air inlet tube which is connected to a pre-cleaner of the engine so that the air is drawn from the precleaner to the throat of the venturi.

Spark arrestors are frequently used in conjunction with mufflers, and the conventional spark arrestor includes a structure which will swirl the exhaust gases so that the solid particles will be thrown outward by centrifugal force and collected in a collection chamber.

Combined spark arrestors and aspirating mufflers have also been marketed, and in the combination unit the exhaust gases initially pass through the spark arrestor section, and after removal of the solid particles, the exhaust gases flow through a plug-type muffler section. The plug-type muffler, as used in the past, includes a solid baffle disposed across an inner tube which is spaced inwardly of the housing, and the solid baffle deflects the exhaust gases outwardly through perforations into the chamber between the inner tube and the housing, and the flow is then redirected via perforations back into the inner tube on the opposite side of the baffle. To accommodate the plug-type construction, the dimensions of the outer body or housing must necessarily be increased and the resulting size not only adds substantial cost to the unit, but when mounted vertically on a tractor, results in an increased obstruction to visibility.

SUMMARY OF THE INVENTION

The invention is directed to an improved spark arrestor, aspirating muffler which has a substantially reduced overall body size, as compared with similar units used in the past. In accordance with the invention, the unit includes an outer body or housing having an exhaust gas inlet conduit in one end and a gas outlet conduit in the opposite end. Located within the body downstream of the gas inlet conduit is a baffle containing a series of circumferentially spaced, louvered openings, and a tube is secured to the downstream side of the baffle and is located radially outward of the openings.

The exhaust gases pass through the louvered openings and are swirled outwardly, and the solid particles in the gas are thrown against the inner surface of the tube and are directed from the downstream end of the tube to a collection chamber.

The exhaust gases are discharged from the interior of the tube through a venturi which is connected to the outlet conduit. The venturi includes a throat section that communicates with the inner end of an air inlet tube which is connected to the pre-cleaner of the engine, so that the air is drawn through the air inlet tube to the throat of the venturi.

As the muffler of the invention eliminates the plug-type construction that has been used in the past, a substantial reduction in the size of the oval body is achieved and this results in a considerable material cost saving.

As the ovality of the body is reduced in size, the muffler provides less of an obstruction to visibility when mounted vertically on the engine of a tractor.

Due to the smaller size and weight of the unit, a less complicated supporting structure is required to mount the unit on the tractor engine and fatigue due to engine vibration is minimized.

Other objects and advantages will appear in the course of the following description.

DESCRIPTION OF THE DRAWINGS

The drawings illustrate the best mode presently contemplated of carrying out the invention.

In the drawings:

FIG. 1 is a side elevation showing the muffler as mounted on the engine of a tractor;

FIG. 2 is a longitudinal section of the muffler;

DESCRIPTION OF THE PREFERRED EMBODIMENT

Figure 3:
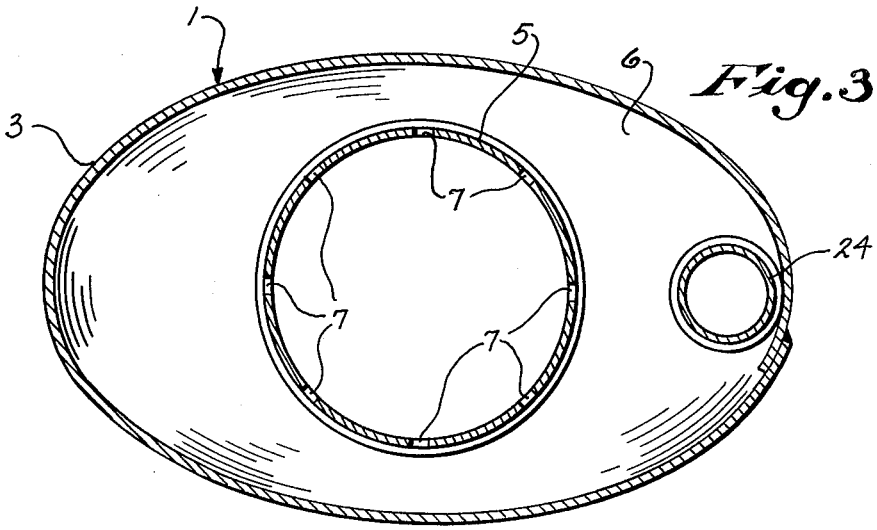
FIG. 3 is a section taken along line 3—3 of FIG. 2.
Figure 4:
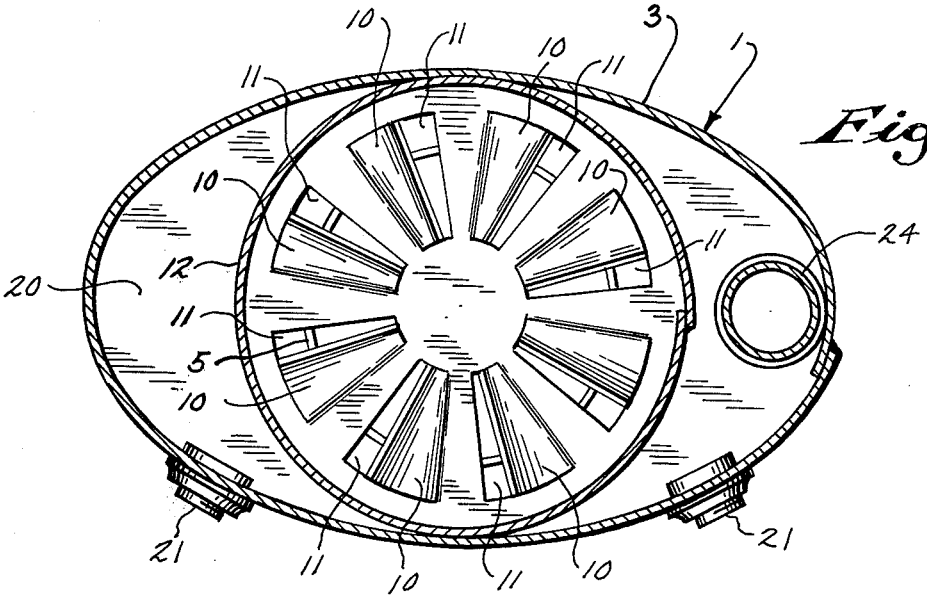
FIG. 4 is a section taken along line 4—4 of FIG. 2.
Figure 5:
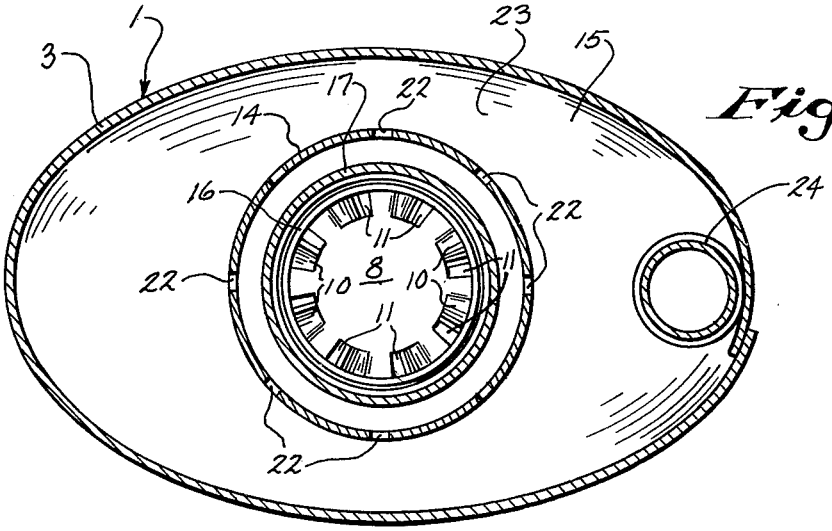
FIG. 5 is a section taken along line 5—5 of FIG. 2.

FIG. 1 illustrates the spark arrestor aspriating muffler 1 of the invention as used in conjunction with the internal combustion engine of a tractor 2. The spark arrestor, aspirating muffler comprising an outer oval body 3, having open ends which are enclosed by heads 4 and **4*a***, respectively.

Exhaust gases from the tractor engine are introduced into the body 3 through an exhaust gas inlet tube 5 which is mounted within an opening in head 4 and within an opening in a baffle 6 which is secured to the inner surface of the body 3. To improve the sound attenuation, the tube 5 is provided with a plurality of perforations 7 which extend generally from a location adjacent the head 4 to the inner end of the tube. As the exhaust gases flow through tube 5 the sound energy passes through the perforations 7 into the chambers between the tube 5 and the body 3 to thereby attenuate the sound energy.

Located downstream of the end of the exhaust gas inlet tube 5 is a baffle 8 having a peripheral flange 9 which is welded to the inner surface of the body 3. The baffle 8 is provided with a series of circumferentially arranged openings 10 which are bordered by louvers 11. The central portion of baffle 8 located radially inward of openings 10 is closed off and is axially aligned with tube 5. As shown in FIG. 2, a tube 12 is secured to the downstream side of the baffle 8 and is located radially outward of the louvered openings 10.

Mounted in an opening in the head **4*a* is a venturi assembly 13, and the venturi assembly includes an outer cylindrical tube 14 which is secured within aligned openings in head 4*a* and baffle 15. As illustrated in FIG. 2, the inner end of the tube 14 projects upstream of the downstream end of the tube 12 and is spaced radially inward of the tube 12** to provide an annular clearance therebetween.

The venturi assembly also includes a converging inlet section 16 which is secured within the inner end of the tube 14, and a generally conical, diverging outlet section 17 which is positioned in tube 14 by ring 18 and is spaced from the inlet section to provide a throat 19.

The exhaust gases being discharged from the inlet tube 5 will pass through the louvered openings 10 and are swirled outwardly against the inner surface of the tube 12. The solid particles, having a greater density, will be thrown outwardly by centrifugal force against the inner surface of the tube 12 and move downstream through the annular clearance between tube 12 and tube 14 into the collection chamber 20. A pair of clean-out plugs 21 are threaded within holes at the bottom of the chamber 20 to permit periodic removal of the collected solid particles.

The exhaust gases are discharged from tube 12 into the inlet section 16 of the venturi 13, and due to the converging configuration, the velocity of the gases will increase at the throat 19 with a resulting pressure drop. To provide an aspirating action, the tube 14 is formed with a plurality of perforations 22 which provide communication between the throat section 19 and chamber 23 which is defined by the baffle 15 and head 4. Air tube 24 which extends longitudinally of the oval body and the inner end of air tube 24 communicates with chamber 23, while the outer end is connected to the pre-cleaner of the engine. As shown in FIG. 2, the air tube 24 is secured within aligned openings in the baffle 8 and head 4, and the air tube also passes through an opening in the baffle 6, but is spaced from the baffle to facilitate assembly.

Due to the pressure drop at the throat section 19 of the venturi 13, air is drawn through the air inlet tube 24 from the engine pre-cleaner and passes through chamber 23 and perforations 22 into the throat section 19 for discharge through the venturi.

The configuration and position of the louvered openings 10 in baffle 8, with relation to the venturi 13 enables the overal size of the body 1 to be reduced without a proportional increase in noise level and while maintaining a comparable pressure drop through the unit. This result is unexpected in that one would normally expect that the utilization of smaller, more restrictive louvered openings along with the elimination of the plug section would result in a lesser attenuation of sound and a greater noise level.

As the overall size of the oval body is reduced a considerable material cost saving is realized. Furthermore, due to the reduction in size and weight, a less complicated supporting structure is required to mount the unit vertically on the engine and less fatigue is produced due to engine vibration.

As a further advantage, the reduction in size of the oval body results in a decreased obstruction to visibility when the unit is mounted vertically on the engine of a tractor.

Various modes of carrying out the invention are contemplated as being within the scope of the following claims particularly pointing out and distinctly claiming the subject matter which is regarded as the invention.

We claim:

1. A combined spark arrestor and aspirating muffler, comprising an outer body having exhaust gas inlet means for receiving exhaust gases from an engine and having gas outlet means for discharging gases from the body, a baffle disposed transversely across the body and having a plurality of openings therein, a tubular member located radially outward of the openings and secured to the downstream side of the baffle, means operably connected to the openings for causing exhaust gas passing through said openings to be swirled outwardly in said tubular member, a collection chamber communicating with the peripheral portion of the downstream end of the tubular member to collect solid particles from the exhaust gases, a venturi establishing communication between the central portion of the downstream end of the tubular member and said outlet means, said venturi having a throat portion disposed within the body, and an air inlet conduit communicating with the throat portion, air being drawn into said throat portion as the exhaust gases pass through the venturi.

2. The structure of claim 1, in which the downstream end of the tubular member extends downstream beyond the upstream end of the venturi and is spaced radially outward of the upstream end of the venturi to provide an annular passage therebetween, said annular passage providing communication between the interior of the tubular member and the collection chamber.

3. The structure of claim 2, in which the tubular member is spaced radially inward of the inner wall of the body to define the collection chamber.

4. The structure of claim 1, wherein the openings in the baffle are spaced radially outward of the axis of the body.

5. The structure of claim 1, wherein said inlet means includes an inlet conduit having a plurality of perforations therein,

6. The structure of claim 1, wherein said air inlet conduit extends through a first end of said body and is disposed generally parallel to the axis of the body.

7. The structure of claim 6, and including a second baffle disposed transversely of the body and spaced from the second end of the body to provide a second chamber therebetween, the inner end of the air inlet conduit communicating with said second chamber and said second chamber communicating with the throat portion of the venturi.

8. A combination spark arrestor and aspirating muffler, comprising a generally oval outer body having a first end and a second end, an exhaust gas inlet conduit disposed in said first end for conducting exhaust gas to the body, outlet means disposed in the second end, a baffle disposed transversely across the body and including a plurality of circumferentially arranged louvered openings, a tubular member located radially outward of the openings and secured to the downstream side of the baffle, said tubular member being spaced radially inward of the body to provide a collection chamber therebetween, a venturi connected to said outlet means and disposed in axial alignment with said tubular member, the downstream end of the tubular member extending downstream beyond the upstream end of the venturi and the downstream end of the tubular member being spaced radially outward of the venturi to provide a passage that establishes communication between the interior of the tubular member and the collection chamber, said venturi including a throat portion, and air inlet conduit means communicating with the throat portion of the venturi, exhaust gases entering the inlet conduit being swirled outwardly as the gases pass through said louvered openings with solid particles being thrown outwardly by centrifugal force against the inner surface of the tubular member and passing through said passage to said collection chamber, air being drawn through said air inlet conduit means to the venturi by virtue of the reduction in pressure as said exhaust gases are discharged through said venturi.

9. The structure of claim 8, wherein said venturi includes a generally cylindrical outer member, a converging inlet section communicating with said tubular member and secured within said outer member, said venturi also including a generally conical diverging outlet section secured to said outer member and spaced downstream from the inner section to provide said throat portion, said outer member having a plurality of ports providing communication between said throat portion and said air inlet conduit means.

10. The structure of claim 7, wherein said venturi includes a generally cylindrical outer member, a generally conical converging inlet section communicating with said tubular member and secured to said outer member, said venturi also including a generally conical diverging outer section secured to said outer member and spaced axially from said inlet section to provide said throat portion, said outer member having a plurality of perforations providing communication between said throat portion and said second chamber.

11. The structure of claim 7, wherein the central portion of the first named baffle disposed radially inward of said openings is closed and is axially aligned with said gas inlet conduit.

* * * * *